US008400362B2

(12) United States Patent
Watanabe

(10) Patent No.: US 8,400,362 B2
(45) Date of Patent: Mar. 19, 2013

(54) RADIO COMMUNICATION APPARATUS AND METHOD FOR MAKING RADIO COMMUNICATION APPARATUS

(75) Inventor: Hiroshi Watanabe, Tokyo (JP)

(73) Assignee: Fujitsu Mobile Communications Limited, Kawasaki (JP)

( * ) Notice: Subject to any disclaimer, the term of this patent is extended or adjusted under 35 U.S.C. 154(b) by 550 days.

(21) Appl. No.: 12/546,037

(22) Filed: Aug. 24, 2009

(65) Prior Publication Data

US 2010/0090914 A1 Apr. 15, 2010

(30) Foreign Application Priority Data

Oct. 14, 2008 (JP) ..... 2008-264939

(51) Int. Cl.
*H01Q 1/24* (2006.01)

(52) U.S. Cl. ..... 343/702; 343/822

(58) Field of Classification Search ..... 343/702, 343/787, 729, 725, 728, 788, 822
See application file for complete search history.

(56) References Cited

U.S. PATENT DOCUMENTS 7,081,853 B2 * 7/2006 Amano et al. ..... 343/702
8,219,143 B2 7/2012 Waku et al.

FOREIGN PATENT DOCUMENTS

JP 2007-306287 A 11/2007
JP 2007306287 A * 11/2007
WO 2008/041652 A1 4/2008

OTHER PUBLICATIONS

JP Office Action mailed on Sep. 25, 2012 in application No. 2008-264939.

* cited by examiner

*Primary Examiner* — Hoang V Nguyen
*Assistant Examiner* — Kyana R McCain
(74) *Attorney, Agent, or Firm* — Mascoff Brennan

(57) ABSTRACT

A radio communication apparatus configured to be used for first radio communication and second radio communication which are different from each other is provided. The radio communication apparatus has a first antenna, a coupling reduction element, a magnetic material sheet and a second antenna. The first antenna is configured to be used for the first radio communication, and is formed by a conductive line wound in a plane like a coil. The coupling reduction element is formed by a plane-shaped conductor, provided almost parallel to the plane of the first antenna, and configured to be put in a condition of electrical floating. The magnetic material sheet is provided between the first antenna and the coupling reduction element. The second antenna is configured to be used for the second radio communication, and is provided close to at least a portion of the first antenna.

10 Claims, 3 Drawing Sheets

RADIO COMMUNICATION APPARATUS AND METHOD FOR MAKING RADIO COMMUNICATION APPARATUS

CROSS REFERENCE TO RELATED APPLICATIONS

This application is based upon and claims the benefit of priority from the prior Japanese Patent Application No. 2008-264939 filed on Oct. 14, 2008;
the entire contents of which are incorporated herein by reference.

BACKGROUND OF THE INVENTION

1. Field of the Invention

The present invention relates to a radio communication apparatus and a method for making a radio communication apparatus, and in particular to a radio communication apparatus configured to be used for a plurality of kinds of radio communication and a method for making such a radio communication apparatus.

2. Description of the Related Art

Wireless communication technology applied to identification is called radio frequency identification (RFID), and is widely used for automatic ticket gates, working hour management of companies and offices, various kinds of electronic money and so on. In an RFID system, information is transferred from a device called a reader/writer to a data medium called a card or a tag, and vice versa.

The reader/writer and the card each include an antenna formed by a coil-shaped element (sometimes called a loop antenna or a loop coil antenna). Upon putting the antennas in a state where the antennas face opposite each other and to communicate with each other, the reader/writer can write data onto the card and can read data from the card. Some kind of mobile phone is equipped with such a function corresponding to RFID.

A mobile phone has an antenna for mobile communication for a primary purpose of use. Moreover, a mobile phone equipped with a plurality of functions often has another antenna so as to work in a plurality of systems. In some cases, these antennas and the above antenna formed by the coil-shaped element are put close to each other due to limited mounting space. In such a case, the antennas can often be electromagnetically coupled with each other, resulting in that antenna characteristics are affected and a range or quality of communication is degraded.

In order to address such a problem, a mobile phone constituted by including an antenna for mobile communication and an antenna for RFID both formed on a same flexible printed board is known, e.g., as disclosed in Japanese Patent Publication of Unexamined Applications (Kokai), No. 2007-306287. According to JP 2007-306287, the antenna for mobile communication and the antenna for RFID are both formed on the same flexible printed board so that a space between the both antennas is kept constant and their characteristics are made stable. Moreover, an electromagnetic wave shield sheet is put on the flexible printed board so that interference between the reader/writer and a mother board of the mobile phone can be reduced.

The mobile phone disclosed in JP 2007-306287 keeps the space between the antenna for mobile communication and the antenna for RFID constant so as to make their characteristics stable, but does not prevent degradation of the characteristics caused by a coupling between the antennas. Thus, the characteristics may possibly be degraded due to the coupling and may level off depending on conditions.

SUMMARY OF THE INVENTION

Accordingly, an advantage of the present invention is to keep antennas of a radio communication apparatus configured to be used for a plurality of systems from being coupled so as to enhance antenna characteristics.

To achieve the above advantage, one aspect of the present invention is to provide a radio communication apparatus configured to be used for first radio communication and second radio communication which are different from each other. The radio communication apparatus has a first antenna, a coupling reduction element, a magnetic material sheet and a second antenna. The first antenna is configured to be used for the first radio communication, and is formed by a conductive line wound in a plane like a coil. The coupling reduction element is formed by a plane-shaped conductor, provided almost parallel to the plane of the first antenna, and configured to be put in a condition of electrical floating. The magnetic material sheet is provided between the first antenna and the coupling reduction element. The second antenna is configured to be used for the second radio communication, and is provided close to at least a portion of the first antenna.

DETAILED DESCRIPTION OF THE INVENTION

Figure 1:
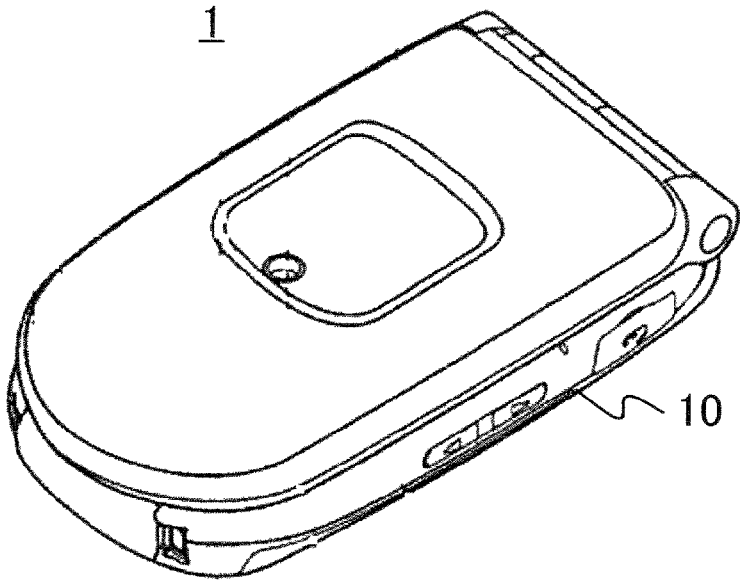
FIG. 1 is a perspective view showing an appearance of a radio communication apparatus of an embodiment of the present invention.

Hereinafter, embodiments of the present invention will be described in detail. In following descriptions, terms such as upper, lower, left, right, horizontal or vertical used while referring to a drawing shall be interpreted on a page of the drawing unless otherwise noted. A same reference numeral given in two or more drawings shall represent a same member or a same portion.

An embodiment of the present invention will be described with reference to FIGS. 1-7. FIG. 1 is a perspective view showing an appearance of a radio communication apparatus 1. The radio communication apparatus 1 is constituted by two housing sections connected to each other and forming a flip type structure. FIG. 1 shows a state that the mobile phone 1 is being folded. The one of the two housing sections of the radio communication apparatus 1 shown on the lower side in FIG. 1 is a housing section 10.

Figure 2:
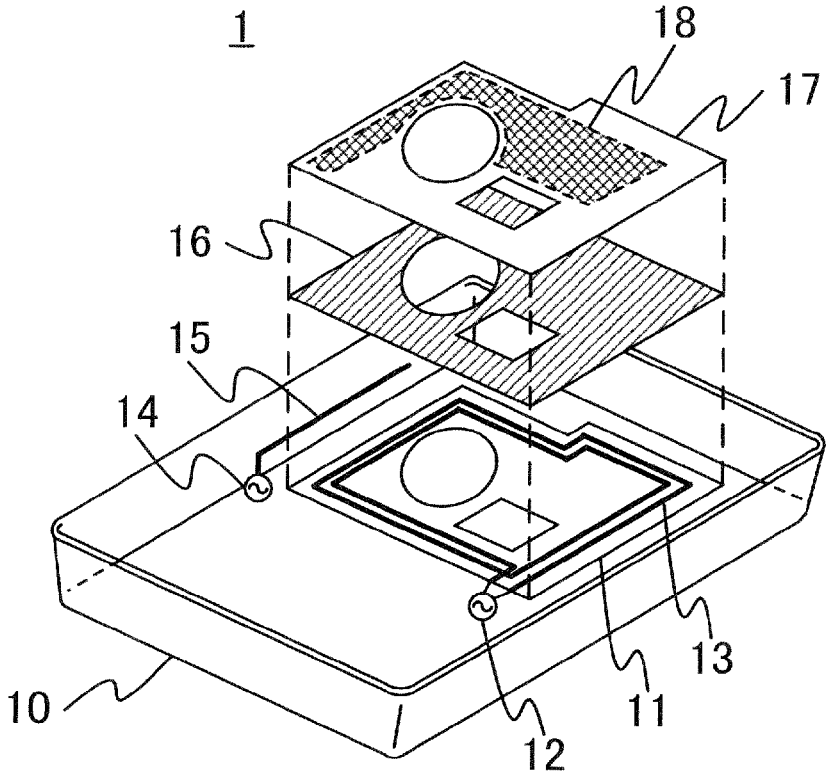
FIG. 2 shows a lower half of a material forming a housing section of the radio communication apparatus of the embodiment, and a configuration of an antenna and so on mounted on the housing section.

FIG. 2 shows, in a simplified manner, a lower half of a material forming the housing section 10 (the lower half portion is hereafter called the housing section 10), and a configuration of an antenna and so on mounted on the housing section 10. The housing section 10 can be modeled, e.g., as shown in FIG. 2, on a shallow, longer than is wide container. Upper and lower sides of the base of the housing section 10 correspond to the inside and the outside of the radio communication apparatus 1, respectively.

A planar flexible printed board 11 is provided on the base of the housing section 10. The flexible printed board 11 is provided with circular and rectangular apertures at positions according to positions of components or modules provided on the base of the housing section 10. The flexible printed board 11 has a conductive pattern wound like a coil, having both ends connected to a first feed portion 12, and thus forming a first antenna 13.

The first antenna 13 is a coil-shaped antenna configured to be used for radio frequency identification (RFID). The first antenna 13 is configured to send and receive an electromagnetic wave to and from an antenna of the other end of communication (a reader/writer or an IC card).

The housing section 10 is provided with a second antenna 15, which is connected to a second feed portion 14, around a side face of the housing section 10. The second antenna 15 is provided around a portion of the first antenna 13 being close to the above side face of the housing section 10. The second antenna 15 is, e.g., an open-ended monopole antenna of a so-called inverted-L type to be used for short range radio communication using a 2.4 GHz band. The frequency and the type of the second antenna 15 are not limited to the above, though.

The flexible printed board 11 is overlaid with a magnetic material sheet 16 provided in such a way as to cover the first antenna 13. The magnetic material sheet 16 is provided with apertures of positions and shapes corresponding to the circular and rectangular apertures of the flexible printed board 11 described above. In FIG. 2, the magnetic material sheet 16 is indicated by diagonal hatching.

The magnetic material sheet 16 is overlaid with a clamp material 17 formed by insulated material. The clamp material 17 is provided with apertures of positions and shapes corresponding to the circular and rectangular apertures of the flexible printed board 11 and the magnetic material sheet 16 described above. The clamp material 17 is provided on its lower face (that is in contact with the magnetic material sheet 16) with a coupling reduction element 18 formed by a plane-shaped conductor.

The coupling reduction element 18 is put almost parallel to a plane formed by the flexible printed board 11. As the lower face of the clamp material 17 provided with the coupling reduction element 18 is on the invisible side in FIG. 2, the outline of the coupling reduction element 18 is indicated by a dashed line and the inside of the outline is indicated by cross-hatching. The coupling reduction element 18 is a kind of parasitic element put in a condition of electrical floating.

Then, an operation of the radio communication apparatus 1 configured as described above will be explained. If the above configuration lacks the coupling reduction element 18, the second antenna 15 and the first antenna 13 (particularly a portion thereof positioned close to the second antenna 15) are electrically coupled, resulting in that the second antenna 15 loses gain (or radiation efficiency). That is because the first antenna 13 forms a portion of a resonance circuit of, e.g., a 13 megahertz (MHz) band and its resonant wavelength is greater than the resonant wavelength of the second antenna 15 by two digits, and thus the second antenna 15 is easily coupled with the first antenna 13 that is electrically longer enough than the second antenna 15 if the first antenna 13 is arranged close to the second antenna 15.

Meanwhile, if the coupling reduction element 18 is provided almost parallel to the first antenna 13, the first antenna 13 is mainly coupled with the coupling reduction element 18, as an area of the coupling reduction element 18 facing the first antenna 13 is greater than that of the second antenna 15. Thus, the part of electromagnetic energy radiated by the second antenna 15 and coupled with the first antenna 13 decreases while the remaining part radiated to space increases and so does the gain (or radiation efficiency) of the second antenna 15.

If the first antenna 13 is mainly coupled with the coupling reduction element 18, eddy current loss due to the coupling between the first antenna 13 and the coupling reduction element 18 through a magnetic field and Q-value degradation of the first antenna 13 may occur. The magnetic material sheet 16 provided between the first antenna 13 and the coupling reduction element 18 can reduce the eddy current loss and the Q-value degradation described above.

Figure 3:
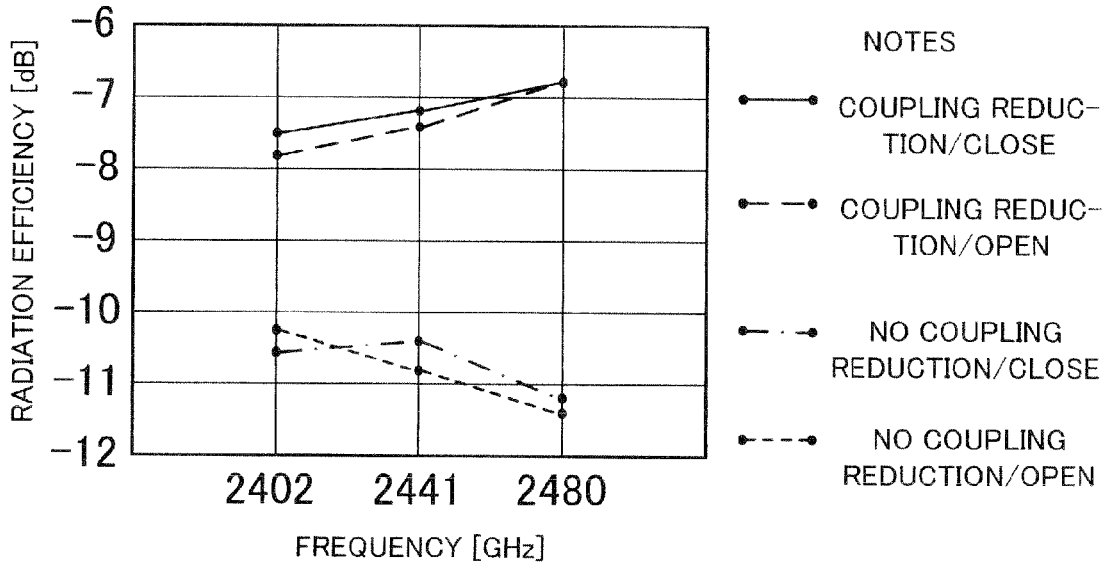
FIG. 3 shows an example of measured data of radiation efficiency of a second antenna of the embodiment in four cases with respect to a configuration and a condition of the radio communication apparatus of the embodiment.

The coupling reduction material 18 provided as described above produces an effect of the radiation efficiency increase of the second antenna 15, and that effect will be explained with reference to FIG. 3. FIG. 3 shows an example of measured data of the radiation efficiency of the second antenna 15 in four cases with respect to the configuration and the condition shown in FIGS. 1 and 2. FIG. 3 shows a horizontal axis representing frequencies (in MHz), and the radiation efficiency was measured at three frequencies shown on the horizontal axis. FIG. 3 shows a vertical axis representing the radiation efficiency (in decibel (dB)).

As noted in FIG. 3, data formed by plots at three frequencies for short-range radio communication connected by a solid line corresponds to a state of the radio communication apparatus 1 in which the coupling reduction element 18 is provided and the two housing sections are folded and closed to each other. Data formed by plots at the three frequencies connected by a dashed line corresponds to a state of the radio communication apparatus 1 in which the coupling reduction element 18 is provided and the two housing sections are open to each other differently from FIG. 1.

Data formed by plots at the three frequencies connected by a dot-and-dash line corresponds to a state of the radio communication apparatus 1 in which the coupling reduction element 18 is not provided, differently from FIG. 2, and the two housing sections are folded and closed to each other. Data formed by plots at the three frequencies connected by a dotted line corresponds to a state of the radio communication apparatus 1 in which the coupling reduction element 18 is not provided, differently from FIG. 2, and the two housing sections are open to each other differently from FIG. 1.

As shown in FIG. 3, the radiation efficiency with the coupling reduction element 18 is a maximum of more than 4 dB better than the radiation efficiency without the coupling reduction element 18, which obviously demonstrates the effect of the present invention.

Figure 4:
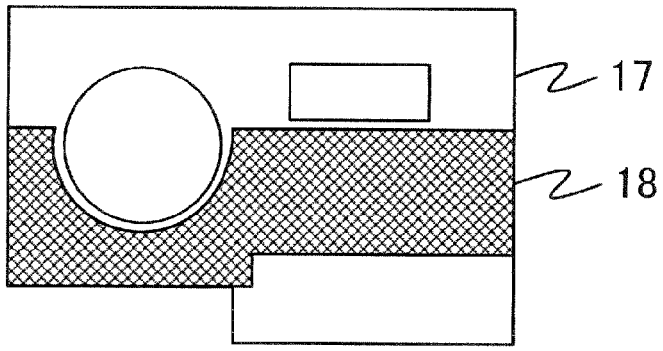
FIG. 4 shows a first example of a shape and a layout of a coupling reduction element provided on a clamp material of the embodiment.
Figure 5:
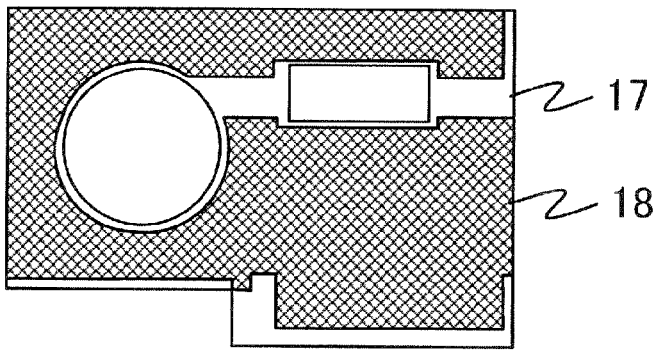
FIG. 5 shows a second example of the shape and the layout of the coupling reduction element provided on the clamp material of the embodiment.
Figure 6:
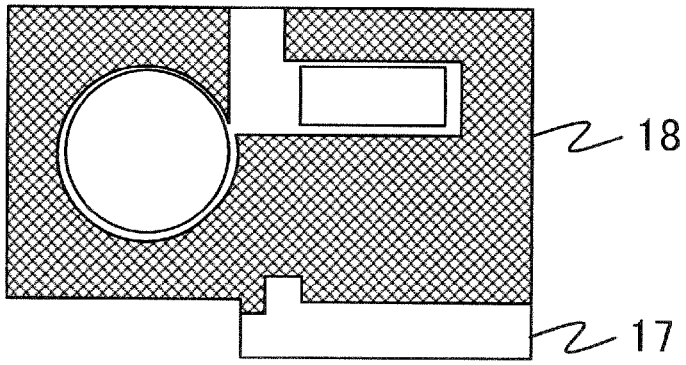
FIG. 6 shows a third example of the shape and the layout of the coupling reduction element provided on the clamp material of the embodiment.

Meanwhile, if the coupling reduction element 18 is provided, the coupling reduction element 18 may possibly cause eddy current loss or Q-value degradation of the first antenna 13. Thus, these problems may be reduced by selecting a shape and a layout of the coupling reduction element 18. FIGS. 4-6 show three shapes and layouts of the coupling reduction element 18 provided on the lower face of the clamp material 17 shown in FIG. 2.

Figure 7:
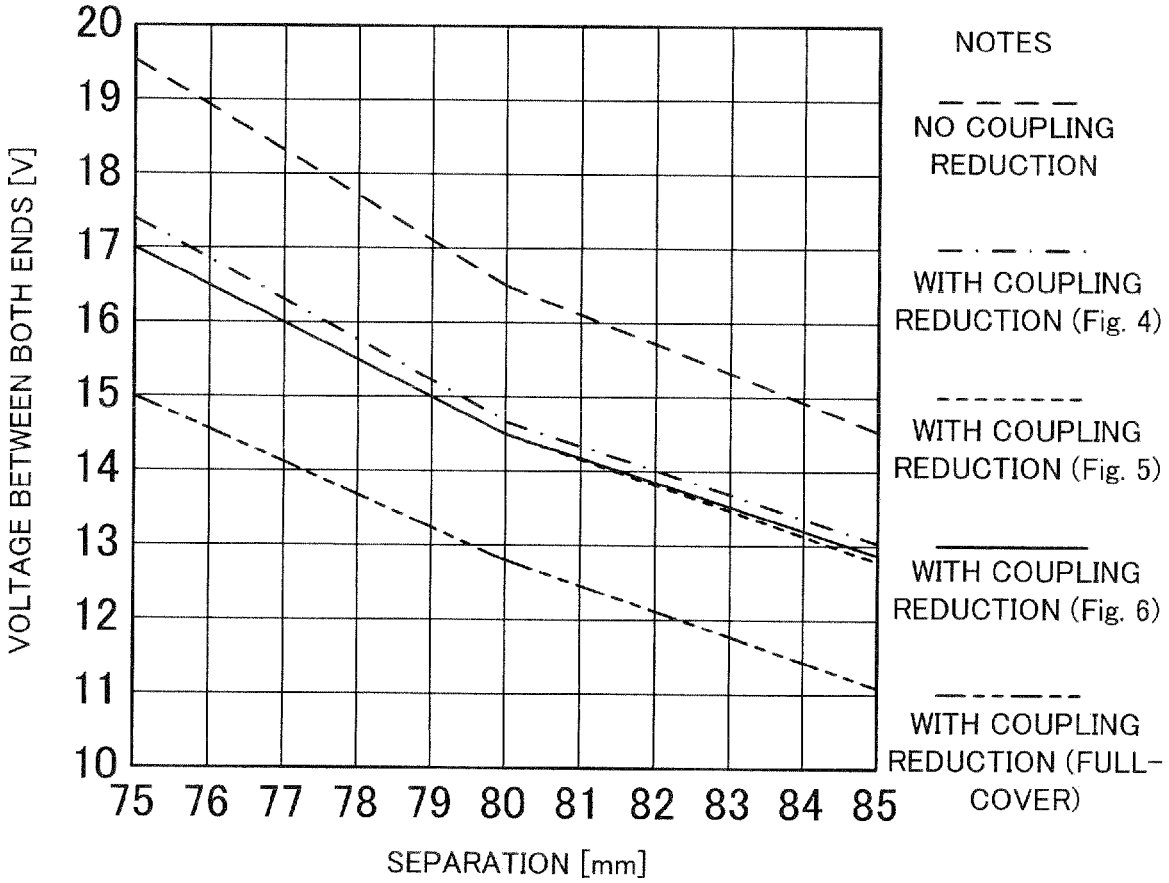
FIG. 7 shows an example of measured data of a voltage obtained between both ends of the first antenna in each of conditions of the shape and the layout of the coupling reduction element of the embodiment.

FIG. 7 shows an example of measured data of a voltage obtained between the both ends of the first antenna 13 upon the radio communication apparatus 1 getting close to an external reader/writer in each of cases where the coupling reduction element 18 has one of the above three shapes, where the coupling reduction element 18 fully covers the clamp material 17, and where the coupling reduction element 18 is not provided.

FIG. 7 shows a horizontal axis representing a separation between the radio communication apparatus 1 and the external reader/writer (in millimeters (mm)), and a vertical axis representing the voltage between the both ends (in volts (V)). As noted in FIG. 7, a dashed line represents data in the case where the coupling reduction element 18 is not provided. The voltage between the both ends obtained in this case, where the above problem does not occur, is higher in the range of the separation shown in FIG. 7 than that obtained in the other cases where the coupling reduction element 18 is provided.

FIG. 7 shows dot-and-dash, dotted and solid lines representing data in cases where the shape and layout of the coupling reduction element 18 are as shown in FIGS. 4-6, respectively. FIG. 7 shows two-dot-and-dash line representing data in a case where the coupling reduction element 18 fully covers the clamp material 17. As the condition of the two-dot-and-dash line is that the coupling reduction element 18 has a maximum area and includes a loop shape that easily causes eddy current loss, the voltage between the both ends lowers most in the range of the separation shown in FIG. 7.

Meanwhile, the coupling reduction element 18 of the shape and layout shown in one of FIGS. 4-6, as having a shape excluding a loop, can reduce the eddy current loss and the Q-value degradation, so that the voltage between the both ends is nearly 2 volts higher in the range of the separation shown in FIG. 7 than that in the case where the coupling reduction element 18 fully covers the clamp material 17.

The first antenna 13 is formed by, but not limited to, a conductive pattern of the flexible printed board 11, and may be formed by, e.g., a conductive pattern of a rigid printed board or wiring material.

According to the embodiment of the present invention described above, a characteristic of an antenna for RFID can be maintained to a certain extent and a radiation efficiency characteristic of an antenna for another system can be enhanced at the same time. In the above description of the embodiment, it is intended that the shape, arrangement, relative position and so on of each of the portions be considered as exemplary only, and thus may be variously modified within the scope of the present invention. The first antenna 13 is, but not limited to, an antenna for an RFID use, and may be an antenna for another use.

The particular hardware or software implementation of the present invention may be varied while still remaining within the scope of the present invention. It is therefore to be understood that within the scope of the appended claims and their equivalents, the invention may be practiced otherwise than as specifically described herein.

What is claimed is:

1. A radio communication apparatus configured to be used for first radio communication and second radio communication which are different from each other, comprising:

a housing section in which a planar printed circuit board is provided on a base of the housing section;

a first antenna configured to be used for the first radio communication, the first antenna being formed by a coil-shaped conductive line wound on a plane of the base of the housing section;

a coupling reduction element formed by a plane-shaped conductor and provided to be almost parallel to the plane of the base of the housing section, the coupling reduction element being configured to be put in a condition of electrical floating;

a magnetic material sheet provided between the first antenna and the coupling reduction element; and a second antenna configured to be used for the second radio communication, the second antenna being provided to surround a portion of the first antenna and located in a vicinity of a side face of the housing section which is not flush with the plane of the base of the housing section, wherein a plane on which the second antenna is formed is not flush with the plane on which the first antenna is formed and the coupling reduction element is coupled with electromagnetic energy radiated by the first antenna and reduces electromagnetic coupling between the first antenna and the second antenna.

2. The radio communication apparatus according to claim 1, wherein the first antenna is configured to send and receive a radio wave by means of electromagnetic induction.

3. The radio communication apparatus according to claim 1, wherein the conductor of the coupling reduction element has a non-looped shape.

4. The radio communication apparatus according to claim 1, wherein the coupling reduction element is shaped and positioned such that an area facing the first antenna of the coupling reduction element is greater than an area facing the second antenna of the coupling reduction element.

5. The radio communication apparatus according to claim 1, wherein the conductive line of the first antenna is formed by a conductive pattern of a rigid or flexible printed board, or a conductive wire.

6. A method for making a radio communication apparatus configured to be used for first radio communication and second radio communication which are different from each other, comprising:

winding a coil-shaped conductive line on a plane of a base of a housing section in which a planar printed circuit board is provided so as to form a first antenna configured to be used for the first radio communication;

forming a coupling reduction element by a plane-shaped conductor, the coupling reduction element being configured to be put in a condition of electrical floating;

providing the coupling reduction element to be almost parallel to the plane of the base of the housing section;

providing magnetic material sheet between the first antenna and the coupling reduction element; and providing a second antenna to surround least a portion of the first antenna and being located in a vicinity of a side face of the housing section which is not flush with the plane of the base of the housing section, the second antenna being configured to be used for the second radio communication, wherein a plane on which the second antenna is formed is not flush with the plane on which the first antenna is formed and the coupling reduction element is coupled with electromagnetic energy radiated by the first antenna and reduces electromagnetic coupling between the first antenna and the second antenna.

7. The method for making a radio communication apparatus according to claim 6, wherein the first antenna is configured to send and receive a radio wave by means of electromagnetic induction.

8. The method for making a radio communication apparatus according to claim 6, wherein the conductor of the coupling reduction element has a non-looped shape.

9. The method for making a radio communication apparatus according to claim 6, wherein the coupling reduction element is shaped and positioned such that an area facing the first antenna of the coupling reduction element is greater than an area facing the second antenna of the coupling reduction element.

10. The method for making a radio communication apparatus according to claim 6, wherein the conductive line of the first antenna is formed by a conductive pattern of a rigid or flexible printed board, or a conductive wire.

* * * * *

UNITED STATES PATENT AND TRADEMARK OFFICE

CERTIFICATE OF CORRECTION

PATENT NO. : 8,400,362 B2
APPLICATION NO. : 12/546037
DATED : March 19, 2013
INVENTOR(S) : Watanabe It is certified that error appears in the above-identified patent and that said Letters Patent is hereby corrected as shown below:

On the Title Page, item (74), under "Attorney, Agent, or Firm", in Column 2, Line 1, delete "Mascoff Brennan" and insert -- Maschoff Brennan --, therefor.

Signed and Sealed this
Twenty-third Day of July, 2013

Teresa Stanek Rea
*Acting Director of the United States Patent and Trademark Office*